United States Patent [19]

Zoina

[11] 4,240,188

[45] Dec. 23, 1980

[54] PROCESS AND DEVICE FOR INTERLACING MULTIFILAMENT YARNS

[75] Inventor: Giuseppe Zoina, Limbiate, Italy

[73] Assignee: SNIA VISCOSA Societa Nazionale Industria Applicazioni Viscosa S.p.A., Milan, Italy

[21] Appl. No.: 33,222

[22] Filed: Apr. 25, 1979

[30] Foreign Application Priority Data

Apr. 28, 1978 [IT] Italy ..... 22806 A/78

[51] Int. Cl.[3] ..... D02G 1/16

[52] U.S. Cl. ..... 28/274; 28/275

[58] Field of Search ..... 28/271, 272, 274, 275; 57/350

[56] References Cited

U.S. PATENT DOCUMENTS

| | | | |
|---|---|---|---|
| 3,220,082 | 11/1965 | Fletcher et al. | 28/276 |
| 3,379,002 | 4/1968 | Rosenstein | 57/350 X |
| 3,417,445 | 12/1968 | Gemeinhardt et al. | 28/275 |
| 3,574,249 | 4/1971 | Cannon | 28/274 |
| 3,971,108 | 7/1976 | Gorrafa | 28/272 |

*Primary Examiner*—Robert Mackey

*Attorney, Agent, or Firm*—Wenderoth, Lind & Ponack

[57] ABSTRACT

A process and a device for interlacing multifilament yarns includes forwarding the yarn through an interlacing zone, to which an interlacing air jet is also conveyed through a nozzle, in a non-rectilinear trajectory which is essentially planar and symmetrical with respect to the jet axis, and under tension. The resultant of the tension forces have a line of application which ideally coincides with the jet axis and a direction opposite to that of the jet. The jet is so directed as to contact the yarn in a zone about the point of application of the resultant force. The nozzle includes an orifice located at the vertex of a convex surface directed towards the yarn trajectory, and means for guiding the yarn near the nozzle and for limiting the freedom of motion of the yarn.

19 Claims, 13 Drawing Figures

PROCESS AND DEVICE FOR INTERLACING MULTIFILAMENT YARNS

BACKGROUND OF THE INVENTION (a) The Field of the Invention

The present invention relates to a process and a device for interlacing multifilament yarns.

(b) The Prior Art

A process is known for imparting a certain degree of coherency to yarns constituted by a plurality of substantially parallel filaments—whereby it is meant that the yarn is without twist or has a very low twist—so that they may be employed in weaving and typically for making warps. The known process consists essentially in directing an air jet onto the yarn which travels in a straight line while limiting the freedom of motion of the yarn and containing and deflecting the air stream after contact with the yarn, to an extent and in a manner which are different from case to case.

Typically such processes are carried out by means of devices which comprise a nozzle and a yarn guide and control organ. It is customary in the art improperly to call both those organs together "nozzle", while they should be considered as two distinct elements even when they are formed in a single body. The nozzle proper is of course essentially an air outlet orifice fed with air under pressure through an air feed passage or channel. The yarn guide and control organ, on the other hand, embodies either yarn guide devices or surfaces which limit the yarn motion in the direction of the air jet axis and/or in a direction perpendicular thereto, and often also comprises curved surfaces which are stricken by and deflect the air jet. In some devices, the nozzle and the guide and control organ are clearly distinguished and this latter sometimes merely consists of a surface, e.g. cylindrical, which limits the motion of the yarn in the direction of the air jet axis and lateraly deflects the flow lines of the air jet (see e.g. Italian Pat. No. 700.695). Other devices, e.g. that of U.S. Pat. No. 2,985,995, and others described in a series of patents which are developments and modifications of this latter, comprise a guide and control organ the functional portion of which is a cylindrical channel through which the yarn passes, while the nozzle is nothing but a bore having an axis perpendicular to the axis of the channel, and from which the air jet enters into the channel and therein acquires swirling motions. In nozzles of this type, it is usual that both the yarn passage channel and the air feed channel be formed in a single body, which justifies the fact that the whole device is called "nozzle".

The known processes and devices make it possible to interlace essentially parallel multifilament yarns at high speeds and with good efficiencies. The degree of coherency is measured, e.g., as described in the cited U.S. Pat. No. 2,985,995, by passing a hook carrying a standard weight between the filaments of the yarn and registering the number of times it is stopped while traversing a given length, or in other words by measuring the number of knots or more exactly "pseudo-knots" which the yarn has acquired. It is obvious that in such measurements the morphology of the yarn is at least temporarily modified by the measuring instrument, and the quantitative results they furnish have a comparison value but do not define or express the intimate structure of the interlaced yarn.

However, such known processes and devices involve a rather substantial consumption of compressed air which increases the cost of the final product. They have other drawbacks as well, different from case to case, e.g. a limitation of the range of yarns which may be processed, difficulties of starting the yarn in the device, sensitivity to tension variations, difficulty of regulation, complexity of construction and control, and so forth. Attempts to eliminate these drawbacks have not been wholly successful.

The present invention completely eliminates such disadvantages, and substantially improves the efficiency and the economy of the yarn interlacing operation, thanks to a process and a device which are based on a new principle, while remaining in the class of pneumatic yarn treatments and devices.

SUMMARY OF THE INVENTION

The process which is the object of the invention is characterized in that the yarn is forwarded through an interlacing zone, to which a jet of an interlacing gas, normally air, is also conveyed, in a non-rectilinear trajectory which is essentially planar and symmetric with respect to the jet axis, and under tension, the resultant of the tensional forces having a line of application which ideally coincides with the jet axis and a direction opposite to that of the jet. The jet is so directed as to contact the yarn in a zone about the point of application of the resultant force, and the freedom of motion of the yarn is limited both in the direction of the jet axis and in the direction perpendicular to such axis and to the plane in which the yarn trajectory lies.

The expression "ideally coincides" is to be understood as follows. The non-rectilinear trajectory of the yarn in the interlacing zone is determined by the contact of the yarn with surfaces located in such zone and in the vicinity of the gas jet. If the friction of the yarn on the surfaces is not taken into account, the yarn tension measured at any point of the yarn axis is constant. Under such conditions, i.e. if there were no friction, the line of application of the resultant of the tensional forces would substantially coincide with the jet axis. The friction, however, causes tension downstream of the surfaces, with respect to the direction of the yarn motion, to be greater than tension upstream thereof, and this difference causes a dissymmetry whereby the aforesaid resultant force is deviated by a small angle with respect to the jet axis, the deviation being towards the downstream direction. In any case, the resultant force is equal as to absolute value and opposite as to direction to the deviating force which may be considered as applied to the yarn to deviate it from the rectilinear trajectory which otherwise it would follow. In other words, the yarn is caused to travel between two fixed points, one situated upstream and the other downstream, of the interlacing zone, and in such zone a deviating force is applied to the yarn in the vicinity of the point in which it is contacted by the gas jet, which force displaces the yarn beyond the straight line defined by the two fixed points, the displacement being approximately in the direction of the jet.

Preferably, the invention is additionally characterized in that the jet is deviated by curved surfaces constituting a part of a cylindrical surface having its axis on the plane of the yarn trajectory and perpendicular to the gas jet axis and having a concavity directed towards the jet, swirling motions being imparted to the gas by such curved surfaces, which additionally serve to limit the freedom of motion of the yarn and to guide such motion in the interlacing zone.

The words "cylindrical surface" are to be understood in their broadest geometric meaning, i.e. as defining a surface generated by a straight line moving along a generatrix while remaining parallel to itself and that such cylindrical surface may have a circular or partially circular cross-section, but also, in general, any curvilinear, e.g. elliptical or generally oval, cross-section.

The device according to the invention comprises a nozzle for feeding and projecting a jet of a gas, practically air, into the interlacing zone, which nozzle comprises an orifice located substantially at the vertex of a convex surface, the convexity thereof being directed towards the trajectory of the yarn. Means guide the yarn in an essentially planar trajectory tangent to such convex surface at least in the vicinity of the nozzle orifice. An element limits the freedom of motion of the yarn both in the direction of the air jet axis and in directions perpendicular thereto and to the plane whereon the yarn trajectory lies. Preferably such element may comprise a grooved body having a plane of symmetry which coincides with the yarn trajectory plane and which has a cross-section, in a plane perpendicular to said last mentioned plane, which comprises a concave surface having its concavity directed towards the nozzle and serving both as a surface for containing and guiding the air jet and for limiting the freedom of motion of the yarn and guiding such motion.

Still preferably, the nozzle has two walls at its top and at the two sides of the orifice of the convex surface which embrace the trajectory of the yarn in the interlacing zone and still more preferably have a configuration, in a plane perpendicular to the air jet axis, which is slightly convex and directed towards the nozzle orifice, on the one and on the other side thereof, and is also preferably convergent towards the orifice.

BRIEF DESCRIPTION OF THE DRAWINGS

The invention will be better understood from the following description of a number of non-limitative embodiments thereof, with reference to the attached drawings wherein.

DETAILED DESCRIPTION OF THE INVENTION

Figure 1:
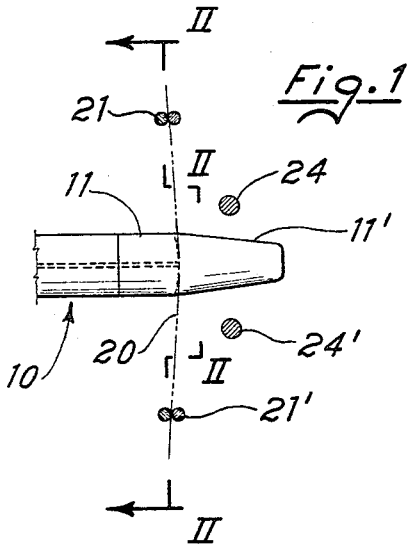
FIG. 1 is a schematic lateral view of a device according to a first embodiment of the invention.
Figure 2:
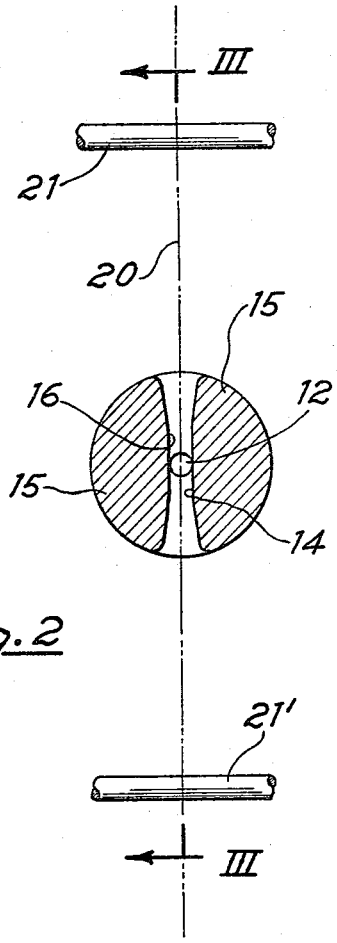
FIG. 2 is a cross-section of FIG. 1 taken as indicated by the broken line II—II—II—II of FIG. 1, but on an enlarged scale.
Figure 3:
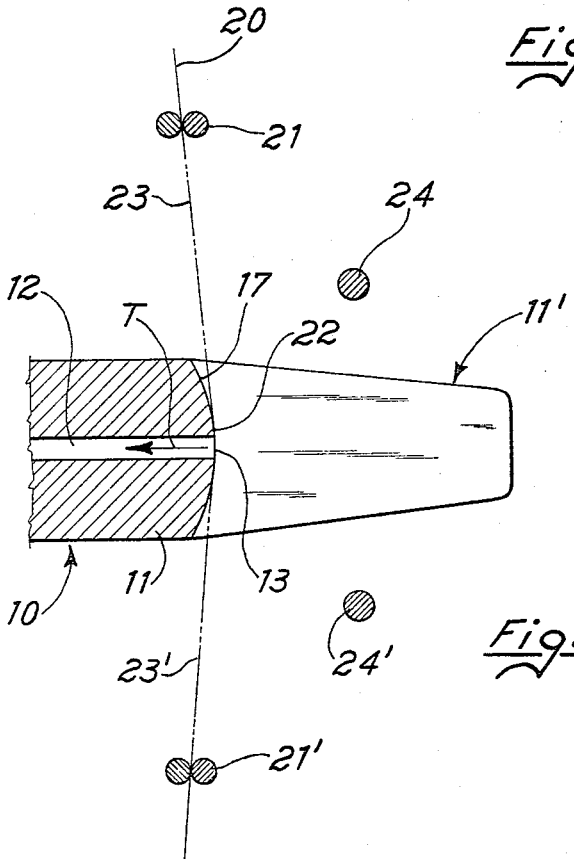
FIG. 3 is a cross-section of FIG. 2 taken along line III—III of FIG. 2.

With reference to FIGS. 1 to 3, in a first embodiment of the invention, the nozzle proper, generally indicated at 10, is constituted by a body having a cylindrical portion 11 which has a channel 12, terminating in an orifice 13, for the passage of compressed air, and which preferably tapers in its upper part 11' wherein it has a groove 14 whereby the nozzle body is reduced to two fins 15. Fins 15 are preferably limited towards the nozzle orifice 13 by surfaces 16 which are convex towards the nozzle. Yarn 20 is guided by suitable devices, e.g. yarn guides 21, 21', in such way that its trajectory comprises (FIG. 3) a curvilinear portion or arc 22 tangent to at least the central portion of a convex surface 17, and portions 23, 23' directed along the tangents to the ends of arc 22. In other words, it might be said that the thread guides or other guide organs 21, 21' tend to impart to the yarn a rectilinear trajectory therebetween and that the nozzle 10 is located in such a position as to deviate the yarn from such trajectory displacing the yarn beyond it in the direction of the air jet. It is obvious that, as a consequence of this arrangement, since the yarn travels with a certain tension, as more fully discussed hereinafter, and given the essential symmetry of the yarn trajectory, the resultant of the tension in the segment 23-22-23', is a force T, the line of application of which ideally coincides (and would actually coincide if there were no friction of the yarn on the nozzle) with the axis of channel 12 and therefore with the compressed air jet axis and is directed oppositely to the air jet, as shown in FIG. 3.

The fins 15 limit the freedom of motion of the yarn in directions which are perpendicular on the one hand to the air jet axis and on the other to the yarn trajectory plane, as is clearly seen in FIGS. 2 and 3. Such fins also limit to a certain extent the flow of the air jet which exits from the nozzle orifice 13.

The movement of the yarn in a direction parallel to that of the air jet is limited by suitable stop members, e.g. by thread guides 24, 24'.

A preferred embodiment of the device is illustrated in FIGS. 4 to 11. As is seen, nozzle 40 is similar to nozzle 10, and is provided with a body 41, a channel 42, and an orifice 43, respectively similar to body 11, channel 12, and orifice 13 of FIGS. 1 to 3, and with a convex surface 47, correponding to surface 17 of FIG. 3, on which the yarn slides and at the center of which the orifice 43 is located, but the fins 45 which correspond to fins 15 are much shorter and are adapted to engage the yarn only in the immediate vicinity of the nozzle orifice.

Figure 6:
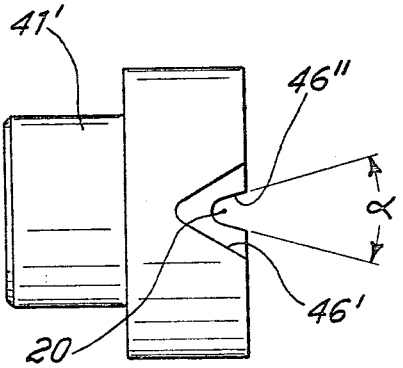
FIG. 6 is a lateral view of the nozzle portion of FIG. 5, a right angle to the plane of FIG. 4.
Figure 7:
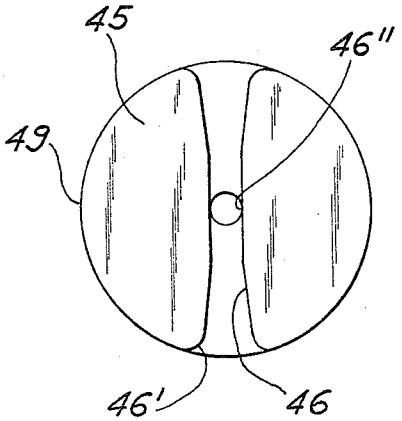
FIG. 7 is an end view of the nozzle.
Figure 8:
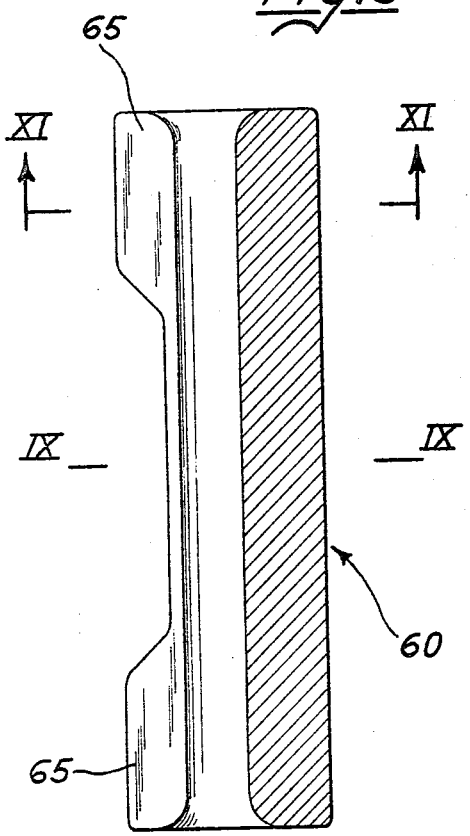
FIG. 8 is an axial cross-section of the guide and control organ in the second embodiment of FIGS. 4 to 7.

Preferably, body 41 is made of two parts, e.g. it may be of metal in its initial portion and have a top or plug 41' (FIGS. 4 to 6) of a ceramic material, wherein all the surfaces which contact the yarn are embodied. In this case too, surfaces 46 of fins 45 have a convexity towards the nozzle, as seen in FIG. 7.

Figure 9:
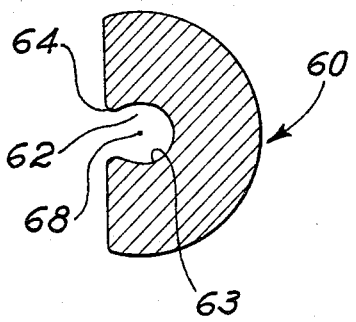
FIGS. 9 and 10 are two cross-sections of the organ, both taken along line IX—IX of FIG. 8 but illustrating two constructional variants.
Figure 10:
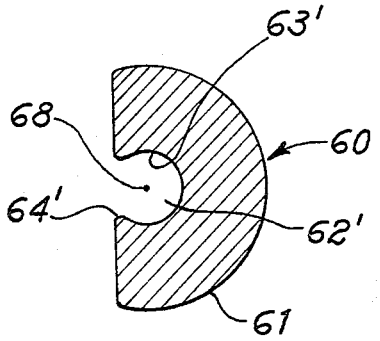
Figure 11:
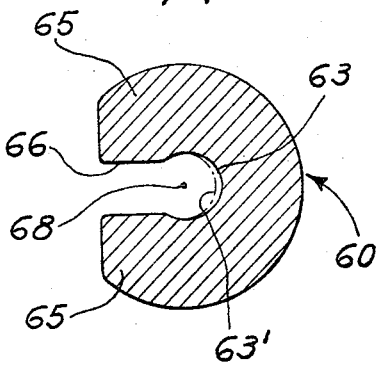
FIG. 11 is a cross-section of the organ taken along line XI—XI of FIG. 8 and illustrating both the variants of FIGS. 9 and 10.

Channel 42 preferably comprises a first cylindrical portion 50, a frusto-conical portion 51 and a narrower cylindrical orifice portion. Surfaces 46, of which FIG. 6 shows the widest profile 46' and the narrowest profile 46'' as they are seen when looking along the yarn trajectory, are slanted inwardly from top to bottom to form a "V" shape and a "U" shape, respectively. The angle $\alpha$ of the two sides of profile 46'' has a certain importance. The yarn control and guide organ, which contains and guides the air jet as well, is constituted by an open sleeve 60, located with its axis lying on the plane of the yarn trajectory and parallel to the average direction of the yarn, which may be identified with the tangent to the trajectory at the point at which the yarn rides over the orifice 43. As is seen in FIGS. 9 to 11, in the interlacing zone, i.e. in a plane perpendicular to the axis 68 of sleeve 60 and passing through the axis of nozzle channel 42 (FIGS. 5, 9 and 10), the sleeve has an outer surface 61 which may be of any shape, though for constructive reasons it is preferably circular cylindrical, and defines in its inner cavity an open concave channel, the cross-section of which may be circular (62', FIG. 10) or oval (62, FIG. 9) and e.g. approximately elliptical with the major axis directed in the direction of the air jet. The inner surface 63 or 63' of such channel spans an angle greater than 180° about the channel axis 68 passing through the center of such surface, which center has a precise geometrical meaning if the surface has a circular or elliptical cross-section as in the drawings, and anyway may be determined at least approximately from symmetry considerations if the surface has any other configuration. Preferably, where the surface ends, the cavity of sleeve 60 is limited by two connecting segments 64 (FIG. 9) or 64' (FIG. 10).

In a plane perpendicular to its axis, distant from the interlacing zone, such as the plane of FIG. 11, the cross-section of sleeve 60 is similar, however it extends at the two sides of the nozzle with fins 65 having rectilinear inner surfaces 66.

In FIG. 11, two possible profiles of the inner channel cavity are shown corresponding to those of FIGS. 9 and 10, the one 63 being elliptical and the other 63' being circular (the latter in broken lines).

Figure 4:
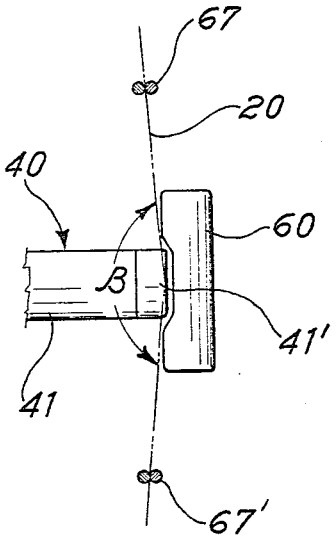
FIG. 4 is a lateral view, similar to FIG. 1, of a second embodiment of the invention.
Figure 5:
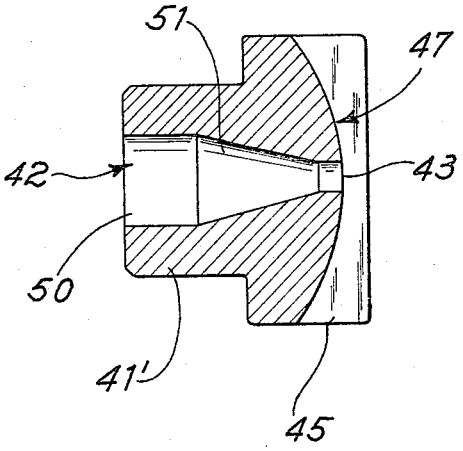
FIG. 5 is an axial cross-section of the terminal portion of the nozzle taken on the plane of the yarn trajectory.

Control and guide organ 60 is preferably arranged with respect to the nozzle as is shown in FIG. 4, in such a way that the yarn will face the opening of channel 62 (FIG. 9) when it is displaced by the air jet.

The device of FIGS. 4 to 11 is also provided with yarn guides 67, 67' or other yarn guide organs which perform the same function as the guide yarns 21, 21' of FIGS. 1 to 3.

The operation of the device hereinbefore described and the process which it carries out are, as has been said, different as to conception from those of the prior art. Indeed the nozzle, and more precisely the portion thereof which constitutes the air orifice and the zone adjacent thereto, has the additional function of deviating the yarn from its theoretical rectilinear trajectory and of imparting thereto a tension having the resultant in the desired direction. As a result, were no air to be fed to the nozzle, the yarn would slide on the nozzle orifice. The air jet displaces the yarn from the orifice and the resultant of the tension urges the yarn constantly back against the orifice. Therefore, the nozzle proper concurrently performs besides its normal air feed function, additional functions which in the prior art devices were performed by different portions of the interlacing device. The nozzle proper according to the invention, besides causing the displacement of the yarn from its rest trajectory by the impact of the air jet also has, as has been said, the function of initially containing such displacement, a further containment being effected by the control and guide organ which, in its simplest form, may be constituted merely by restraining bodies (21—21') as in the embodiment of FIGS. 1 to 3, and in its preferred form comprises a channel wherein not only is the yarn contained and guided, but also the air jet is deflected. Since the yarn has a constant, significant tendency to return towards the nozzle orifice, under the tension to which it is subjected, it does so by sliding on the surface of the guide and control organ cavity, and in all likelihood it rolls on such surface, so that instantaneous twists occur not only by effect of the air vortices but also and mainly by the effect of a planetary motion on the cavity surface, which intensify the interlacement of the yarn and confer to it a marked coherency although its average twist is obviously zero as in the prior art devices.

The preferred dimensional geometrical data of the device according to the invention, are the following: the radius of curvature in the axial plane (of FIGS. 3 and 5) of the yarn guide surfaces in the nozzle (17 or 47 in the embodiments illustrated) varies from 2 mm to 18 mm (greater radiuses causing contact problems). The diameter of orifice 13 or 43 varies from 0.4 mm to 2 mm. Angle $\alpha$, above defined, varies from 25° to 120°. The average diameter of the channel of the guide and control organ varies from 1.5 mm to 6 mm. The distance of the axis 68 (FIGS. 9 to 11) of the guide and control organ channel from the nozzle orifice varies from 0.75 mm to 4.5 mm.

In carrying out the process, the yarn is maintained preferably at a tension between 3 and 300 g. and more preferably between 5 and 150 g., depending on the count. Angle $\beta$, (FIG. 4) defined between the two branches of the yarn, upstream and downstream of the nozzle orifice, varies from 140° to 175°. The pressure at which the compressed air is fed to the nozzle varies from 1 to 8 ATE (relative atmospheres).

The nozzle itself or at least its terminal portion in which the orifice and the surfaces which have been described are formed, is preferably made of a ceramic material, and so is the control and guide organ.

Some embodiments of the process according to the invention will now be described.

EXAMPLE 1

| | |
|---|---|
| count 210/36 | |
| processing speed | = 391 m/1'(sec.) |
| radius of curvature (47) | = 10 mm |
| diameter of the nozzle orifice (43) | = 0.8 mm |
| average diameter of the guide channel (62) | = 3 mm |
| distance of axis (68) of the channel from nozzle orifice (43) | = 2.7 mm |
| angle $\beta$ | = 165° |
| yarn tension | = 20-25 g. |

The average number of pseudo-knots per meter of yarn which are obtained at various pressures are tubulated in the following

TABLE 1

| PRESSURE (ATE) | NUMBER OF KNOTS |
|---|---|
| 2.5 | 22.4 |
| 3 | 27.8 |
| 3.5 | 31.6 |
| 4 | 31.8 |
| 4.5 | 32 |

EXAMPLE 2

| | |
|---|---|
| count 940/136 | |
| processing speed | = 391 m/1' |

-continued

| | |
|---|---|
| radius of curvature (47) | = 10 mm |
| diameter of the orifice (43) | = 1.2 mm |
| angle $\alpha$ | = 40° |
| average diameter of the guide channel (62) | = 4 mm |
| distance of axis (68) of the channel from orifice (43) | = 3.2 mm |
| angle $\beta$ | = 165° |
| yarn tension | = 50–60 g. |

The average number of pseudo-knots per meter of yarn which are obtained at various pressures are tabulated in the following

TABLE 2

| PRESSURE (ATE) | NUMBER OF KNOTS |
|---|---|
| 2.5 | 20.4 |
| 3 | 26.4 |
| 3.5 | 28.5 |
| 4 | 29.8 |
| 4.5 | 29.8 |

Figure 12:
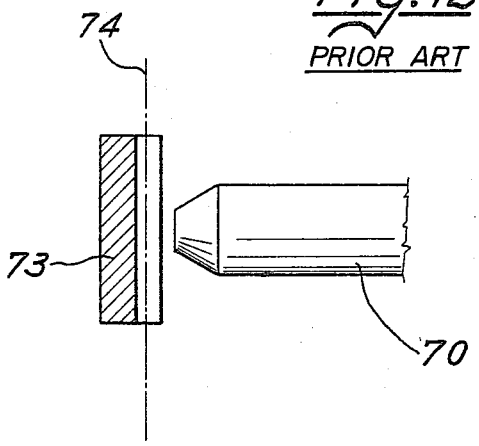
Fig. 12 PRIOR ART
FIGS. 12 and 13 are respectively a lateral view with a part in cross-section and an axial cross-section of a comparison device or "nozzle" built according to the known art.
Figure 13:
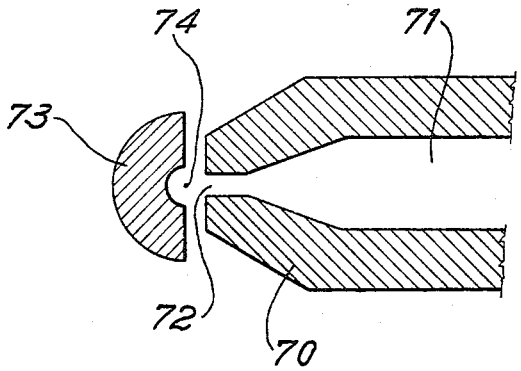
Fig. 13 PRIOR ART

The following Examples 3 and 4 are comparison examples carried out with the device according to the prior art illustrated in FIGS. 12 and 13, wherein 70 is the nozzle proper with a channel 71 and orifice 72, 73 is the control and guide organ in the form of a channel, and 74 is the yarn which follows a rectilinear trajectory.

EXAMPLE 3

| | |
|---|---|
| count 210/36 | |
| processing speed | = 391 m/1' |
| diameter of the nozzle orifice (72) | = 1.5 mm |
| diameter of the guide channel of control and guide organ (73) | = 3 mm |
| yarn tension | = 20–25 g. |

The average number of pseudo-knots per meter of yarn thus obtained are tabulated in the following

TABLE 3

| PRESSURE (ATE) | NUMBER OF KNOTS |
|---|---|
| 2.5 | 11.5 |
| 3 | 15 |
| 3.5 | 19 |
| 4 | 23 |
| 4.5 | 26 |

EXAMPLE 4

| | | |
|---|---|---|
| - count 940/136 | | |
| - processing speed | = | 391 m/1' |
| - diameter of the nozzle orifice (72) | = | 1.5 mm |
| - diameter of the guide channel of control and guide organ (73) | = | 4 mm |
| - distance of the axis (74) of the channel from the nozzle orifice (72) | = | 2.5 mm |
| - yarn tension | = | 50–60 g. |

The average number of pseudo-knots per meter of yarn obtained are tabulated in the following

TABLE 4

| PRESSURE (ATE) | NUMBER OF KNOTS |
|---|---|
| 2.5 | 10 |
| 3 | 12 |
| 3.5 | 13 |

TABLE 4-continued

| PRESSURE (ATE) | NUMBER OF KNOTS |
|---|---|
| 4 | 19 |
| 4.5 | 24 |

A number of non-limitative embodiments of the invention have been described, but the invention may be carried into practice by persons skilled in the art with numerous variations and adaptations.

I claim:

1. A process for interlacing multifilament yarns, said process comprising:

passing a multifilament yarn through an interlacing zone while guiding the travel of said yarn by a first fixed point positioned upstream of said interlacing zone and a second fixed point positioned downstream of said interlacing zone, said first and second fixed points defining therebetween a rectilinear path;

directing a jet of gas against said yarn during passage thereof through said interlacing zone, thereby interlacing the filaments of said yarn;

applying to said yarn, only in the area thereof against which said gas jet impinges, a force, separate from the force of said gas jet, in the direction of and substantially parallel to the axis of said gas jet, thereby imparting a tension to said yarn and deviating said yarn from said rectilinear path and causing said yarn to follow a non-rectilinear trajectory between said first and second fixed points;

restraining the freedom of motion of said yarn, due to said gas jet impinging thereon, in the direction of said axis of said jet; and restraining the freedom of motion of said yarn in opposite directions which are perpendicular both to said axis of said gas jet and to the plane of said non-rectilinear trajectory of said yarn by means of restraining surfaces which continuously diverge from said area at which said gas jet impinges on said yarn.

2. A process as claimed in claim 1, wherein said restraining in said direction of said axis of said gas jet is achieved by curved surfaces which form part of a concave cylindrical surface facing said gas jet and positioned such that an axis thereof is within said plane of said non-rectilinear trajectory and is perpendicular to said axis of said gas jet, and further comprising deflecting said gas jet by said curved surfaces and thereby imparting swirling motion to the gas.

3. A process as claimed in claim 1, wherein said tension imparted to said yarn is from 3 to 300 grams.

4. A process as claimed in claim 3, wherein said tension is from 5 to 150 grams.

5. A process as claimed in claim 1, wherein said gas jet is supplied from compressed air.

6. A process as claimed in claim 5, wherein said compressed air is supplied at a pressure of from 1 to 8 relative atmospheres.

7. A process as claimed in claim 1, wherein said non-rectilinear trajectory includes an upstream branch between said first fixed point and said area and a downstream branch between said area and said second fixed point, and said tensioning force is applied such that said upstream and downstream branches form therebetween an angle of from 140° to 175°.

8. An apparatus for interlacing a multifilament yarn passing through an interlacing zone, said apparatus comprising:

first means, positioned upstream of a yarn interlacing zone, and second means, positioned downstream of said interlacing zone, for guiding movement of a multifilament yarn to be passed through said interlacing zone, said first and second guiding means defining therebetween a rectilinear path;

nozzle means, positioned adjacent said interlacing zone, for feeding and directing a jet of gas against said yarn during passage thereof through said interlacing zone, and for thereby interlacing the filaments of said yarn;

said nozzle means including a curved convex surface directed toward said yarn passing through said interlacing zone, said curved convex surface having substantially at a vertex thereof an orifice through which said gas jet issues and is directed against said yarn;

said nozzle means being positioned relative to said first and second guiding means such that said curved convex surface, only at the area thereof adjacent said orifice, forms means for applying to said yarn, only at the area thereof against which said gas jet impinges, a force in the direction of and substantially parallel to the axis of said gas jet, and for thereby imparting a tension to said yarn and deviating said yarn from said rectilinear path and causing said yarn to follow a non-rectilinear trajectory between said first and second guiding means;

first restraining means, positioned adjacent said interlacing zone, for restraining the freedom of motion of said yarn, due to said gas jet impinging thereon, in the direction of said axis of said gas jet; and second restraining means for restraining the freedom of motion of said yarn in opposite directions which are perpendicular both to said axis of said gas jet and to the plane of said non-rectilinear trajectory of said yarn, said second restraining means comprising a pair of restraining surfaces positioned to define therebetween a space for passage of said yarn through said interlacing zone and located on opposite sides of said orifice, said restraining surfaces each having opposite ends, each said restraining surface continuously diverging from a portion thereof adjacent said orifice to said opposite ends, and adjacent ends of said pair of restraining surfaces defining openings for the free passage of gas.

9. An apparatus as claimed in claim 8, wherein said first restraining means comprises a grooved body having a plane of symmetry coinciding with said plane of said non-rectilinear trajectory, said body having a concave inner surface directed toward said nozzle means.

10. An apparatus as claimed in claim 9, wherein said concave inner surface has a partially circular cross-sectional configuration.

11. An apparatus as claimed in claim 9, wherein said concave inner surface has a partially oval cross-sectional configuration.

12. An apparatus as claimed in claim 9, wherein said concave inner surface has an average diameter of from 1.5 to 6.0 mm.

13. An apparatus as claimed in claim 9, wherein said concave inner surface has an axis which is spaced from said orifice by from 0.75 to 4.5 mm.

14. An apparatus as claimed in claim 8, wherein said pair of restraining surfaces are on a pair of walls which are integral with and extend outwardly from said curved convex surface of said nozzle means adjacent said vertex thereof.

15. An apparatus as claimed in claim 14, wherein each of said walls has a convex configuration, as viewed in a plane perpendicular to said axis of said gas jet, which is directed toward said orifice.

16. An apparatus as claimed in claim 15, wherein each of said walls is convergent toward said orifice.

17. An apparatus as claimed in claim 16, wherein said convergent walls define therebetween an angle between 25° and 120°.

18. An apparatus as claimed in claim 8, wherein said curved convex surface of said nozzle means has a radius of curvature of from 2 to 8 mm.

19. An apparatus as claimed in claim 8, wherein said orifice has a diameter of from 0.4 to 2.0 mm.

* * * * *